US011546705B2

(12) United States Patent
Chen

(10) Patent No.: US 11,546,705 B2
(45) Date of Patent: Jan. 3, 2023

(54) ADAPTIVE MULTI-BAND HEARING DEVICE

(71) Applicant: GN Audio A/S, Ballerup (DK)

(72) Inventor: Colin Chen, Ballerup (DK)

(73) Assignee: GN AUDIO A/S, Ballerup (DK)

( * ) Notice: Subject to any disclaimer, the term of this patent is extended or adjusted under 35 U.S.C. 154(b) by 0 days.

(21) Appl. No.: 17/351,570

(22) Filed: Jun. 18, 2021

(65) Prior Publication Data

US 2021/0400403 A1 Dec. 23, 2021

(30) Foreign Application Priority Data

Jun. 22, 2020 (CN) ..... 202010572633.5
Jul. 7, 2020 (DK) ..... PA2020 00814

(51) Int. Cl.
*H04R 25/00* (2006.01)

(52) U.S. Cl.
CPC ..... *H04R 25/554* (2013.01); *H04R 2225/51* (2013.01)

(58) Field of Classification Search
CPC ..... H04R 1/1016; H04R 3/00; H04R 5/04; H04R 3/04; H04R 3/002; H04R 2201/40; H04R 2420/07; H04R 3/005; H04R 25/505; H04R 25/30; H04R 25/554; H04R 25/70
See application file for complete search history.

(56) References Cited

U.S. PATENT DOCUMENTS 8,879,983 B2 11/2014 Yun et al.
10,475,456 B1 11/2019 Bhatia et al.
10,630,421 B1 4/2020 Jorgovanovic et al.
2005/0078838 A1* 4/2005 Simon ..... H03G 5/025 381/98
2015/0092575 A1 4/2015 Khay-Ibbat et al.
(Continued)

FOREIGN PATENT DOCUMENTS

WO 9741549 A1 11/1997

OTHER PUBLICATIONS

Search Report and Search Opinion issued in Danish Application No. PA 2020 00814, dated Jan. 4, 2021.
(Continued)

*Primary Examiner* — Amir H Etesam
(74) *Attorney, Agent, or Firm* — Hamre, Schumann, Mueller & Larson, P.C.

(57) ABSTRACT

A hearing device configured for audio communication is disclosed. The hearing device comprises a wireless communication unit and a processing unit, the wireless communication unit being configured to receive and transmit audio signals. The processing unit is configured to receive and/or transmit the audio signal from/to the wireless communication unit, process the audio signal in a first frequency band or in a second frequency band, and detect the quality of the audio communication. If the audio signal is processed in the first frequency band, the processing unit is switching to processing in the second frequency band if the quality of the audio communication is below a first predetermined threshold. If the audio signal is processed in the second frequency band, the processing unit is switching to processing in the first frequency band if the quality of the audio communication is above the first predetermined threshold.

12 Claims, 6 Drawing Sheets

(56) References Cited

U.S. PATENT DOCUMENTS

| | | | |
|---|---|---|---|
| 2015/0235644 | A1 | 8/2015 | Son et al. |
| 2016/0373899 | A1 | 12/2016 | Celinski et al. |
| 2016/0381691 | A1 | 12/2016 | Panchal |
| 2019/0371345 | A1 | 11/2019 | Bhatia et al. |

OTHER PUBLICATIONS

The extended European search report issued in European application No. 21180212.9, dated Nov. 22, 2021.

Anonymous: "LAME resampling/lower sample rate questions", Mar. 4, 2012, XP055860423, Retrieved from the Internet: URL:https://hydrogenaud.io/index.php?topic =93815.0, 6 pages provided.

* cited by examiner a)

b)

a)

b)

a)

b)

ADAPTIVE MULTI-BAND HEARING DEVICE

FIELD

The present disclosure relates to a system, a method and a hearing device for audio communication configured for switching between different frequency bands on the basis of audio communication quality.

BACKGROUND

Existing hearing devices often have connectivity issues, especially in a dual connection scenario, i.e. when one hearing device connects with two hosts and in high density environments with a number of wireless devices. Connectivity issues result in degraded signal quality and inconsistent signal quality over time even in case of audio communication with low signal resolution.

U.S. Pat. No. 8,879,983 discloses a communication system which includes sets of complementary radios for transmitting and receiving signals to achieve reliable audio communication. The system disclosed in U.S. Pat. No. 8,879,983 requires at least two radios what usually increases cost and complexity of the system. Additionally, existing systems which comprise one radio cannot easily be upgraded with additional radios as it would require major changes in a hardware device of the system.

There is a need for a simplified and low cost hearing device with improved connectivity capabilities. Additionally, there is a need for a solution which would allow a quick and easy upgrade of existing hearing devices.

SUMMARY

It is an object of embodiments of the present invention to provide a hearing device with improved connectivity capabilities.

It is a further object of embodiments of the present invention to provide a hearing device with improved range performance.

It is a further object of embodiments of the present invention to provide a reliable and low cost hearing device.

It is a further object of embodiments of the present invention to provide a hearing device which allows active use of two or more channels.

It is a yet further object of embodiments of the present invention to provide a solution which would allow for simple and low cost upgrades of existing hearing devices.

In the first aspect, disclosed is a hearing device configured for audio communication. The hearing device comprises a wireless communication unit and a processing unit. The wireless communication unit is configured to receive and transmit audio signals. The processing unit is configured to receive and/or transmit the audio signal from/to the wireless communication unit. The processing unit is further configured to process the audio signal in a first frequency band or in a second frequency band. The processing unit is also configured to detect the quality of the audio communication. If the audio signal is processed in the first frequency band, the processing unit is configured to switch to the second frequency band if the quality of the audio communication is below a first predetermined threshold. If the audio signal is processed in the second frequency band, the processing unit is configured to switch to the first frequency band if the quality of the audio communication is above the first predetermined threshold.

The hearing device may be a personal communication unit, a headset, a wireless headset, headphone, speakerphone, earphone, earbuds, hearable, communication device, audio communication device, wireless audio device, or the like.

The hearing device performs audio communication with or via at least one electronic device, herewith referred as a host device. The hearing device may receive audio signals sent from the host device, and the host device may receive audio signals transmitted from the hearing device. The hearing device may receive audio signals sent from a far-end caller via the host device, as well as transmit audio signals to the far-end caller via the host device. The hearing device may be used by users which may want to receive audio via the host device from the far-end caller, when in a call. Alternatively and additionally, the users may want to receive audio via the host device from, e.g., a music application. The hearing device may be used by users which may want to transmit their own speech to the host device. The host device may transmit speech from a far end caller(s). The host device may also transmit any other form of audio signals, such as music, audio books, movie soundtrack, and similar. The host device may be a smartphone, laptop, loudspeaker, TV, gaming console, tablet, etc., communicating with the hearing device on a predefined ISM band/channel. The host device may run a softphone application, IP telephony, etc., configured for communication with the hearing device on a predefined ISM band/channel.

The hearing device may be in audio communication with two or more hosts through two or more separate channels. The two or more hosts may be used when the user may want to switch from using, e.g. a laptop as host when sitting at the laptop, to using a mobile phone as host when moving away from the laptop, e.g. during a call. Audio communication on two or more channels may simultaneously be active. In the following, reference will be made to only one host device. However, it should be understood that the entire disclosure is equally applicable for two or more host being in audio communication with the hearing device.

The hearing device comprises a wireless communication unit which enables connection to the host by using any protocol as known for a person skilled in the art, including Bluetooth, including Bluetooth Low Energy, Bluetooth Smart, etc., WLAN standards, manufacture specific protocols, such as tailored proximity antenna protocols, such as proprietary protocols, such as low-power wireless communication protocols, such as CSR mesh, etc. The wireless communication unit may also communicate with a dongle which may be directly connected to the host device via USB port thereby establishing connection between the hearing device and the host. The wireless communication unit receives audio signals sent from the host and transmits audio signals to the host. The wireless communication unit is typically connected to a processing unit in the hearing device.

The wireless communication unit may be a transceiver or a radio. The wireless communication unit may be interconnected with an antenna element. The wireless communication unit is configured for wireless communication, including wireless data communication, and may in this respect be interconnected with the antenna element for emission and reception of an electromagnetic field. The wireless communication unit may comprise a receiver and/or transmitter, receiver-transmitter pair, transceiver, or a radio, thereby comprising both a receiver and a transmitter. Thus, the wireless communication unit interconnected with the antenna element provides that the antenna may be able to both emit and receive an electromagnetic field.

The audio signals may comprise user's voice, music data, audio books data, movie soundtrack data, voice from a far end caller, and similar.

The processing unit of the hearing device performs digital signal processing of the audio signals received and/or transmitted via the wireless communication unit. The processing unit is typically an integrated circuit capable of performing a number of logic functions thereby processing the audio signals.

The processing unit is configured to receive audio signals from the wireless communication unit as well as to transmit the audio signals to the wireless communication unit. In this manner, the hearing device exchanges audio signals with the host device(s).

The processing unit is configured to process the audio signal in a first frequency band or in a second frequency band. Whether the audio signal is processed in one frequency band or another depends on the quality of audio communication between the hearing device and the host. Both the first and the second frequency band can process all types of audio signals. The processing unit may process the audio signals in more than two frequency bands. The difference between the first and the second frequency band may be in that the second frequency band is less sensitive to noise, less sensitive to co-w channel interference and can provide satisfactory communication on larger range. These advantages come with the price on audio signal quality, i.e. the audio signal processed in the second frequency band may have lower resolution compared to the audio signal processed in the first frequency band. The first frequency band may be a wideband providing audio signals with high resolution and the second frequency band may be a narrowband providing audio signals with lower resolution compared to the wideband signals. The first and the second frequency bands are both characterized with a sampling frequency which in turn defines how much of the frequency bandwidth/range is sampled what provides the differences of narrowband and wideband. Narrowband audio may be sampled at 8 kHz and wideband may be sampled at 16 kHz providing a much wider range of tonalities to pass through.

The frequency band may be an interval in the frequency domain, delimited by a lower frequency and an upper frequency. The frequency band may refer to a portion of the human hearing range, i.e. an audio frequency range. A portion of the audio signal may occupy a range of frequencies carrying most of its energy, called its bandwidth. A frequency band may represent one communication channel or be subdivided into many.

Bandwidth is the difference between the upper and lower frequencies in a continuous band of frequencies. Bandwidth is measured in hertz (Hz). A characteristic of bandwidth is that any band of a given width can carry the same amount of information, regardless of where that band is located in the frequency spectrum. For example, a 3 kHz band can carry a telephone conversation whether that band is at baseband (as in a POTS telephone line) or modulated to some higher frequency. In radio communications, for example, bandwidth is the frequency range occupied by a modulated carrier signal. An FM radio receivers tuner spans a limited range of frequencies. In the context of, for example, the sampling theorem and Nyquist sampling rate, bandwidth typically refers to baseband bandwidth. In some contexts, the signal bandwidth in hertz refers to the frequency range in which the signal's spectral density (in W/Hz or $V^2$/Hz) is nonzero or above a small threshold value. That definition is used in calculations of the lowest sampling rate that will satisfy the sampling theorem. The word bandwidth applies to signals as described above, but is also used to denote system bandwidth, for example in filter or communication channel systems.

The processing unit is further configured to detect the quality of the audio communication. In the present context, the quality of the audio communication relates to the overall performance of the communication between the hearing device and the host, particularly the performance seen by the users of the hearing device and the host. To quantitatively detect and measure the quality of the audio communication, several aspects of the audio communication may be taken into account, such as packet loss, latency, signal-to-noise ratio, throughput, etc. Depending on the quality of the audio communication different levels of performance can be guaranteed. The quality of the audio communication may be affected by various factors as many things can happen to packets of an audio signal as they travel from the host to the hearing device and vice versa. These factors may be physical (distance, environment, device density, etc.) or technical (quality and settings of wireless units of the hearing device and host, etc.). In order to measure and detect the quality of the audio communication, the processing unit may determine above-mentioned factors from either the audio signal to be processed and/or from the wireless signal strength received from the wireless communication unit.

The processing unit may detect the quality of the audio communication, for instance, every millisecond, every second, every 10 seconds, every 20 seconds, every 30 seconds, every minute, or every two minutes, or every three minutes. The processing unit may also continuously monitor the quality of the audio communication for a certain period of time, e.g. one minute or five minutes, and based on all monitored values, decide on how to continue the processing. The processing unit may also perform switching in irregular time intervals when drastic change in the quality of the audio communication is observed. The processing unit may monitor the quality of the audio communication for a predetermined time period, e.g. 10 seconds or shorter or longer, during which the quality of the audio communication will be detected a plurality of times, e.g. 50 times or more. The detected values may then be averaged and the decision on switching may be made based on the obtained average value and only after the predetermined time period. For instance, the quality of the audio communication may be detected to be below the first threshold value in the first measurement, however the switching may occur only after a predetermined switching time. The predetermined switching time is established to avoid frequent switching between the bands.

Once the quality of the audio communication is detected, the processing unit may compare it with predetermined thresholds. Depending on the result of the comparison, the processing unit may decide if the processing should remain within the same frequency band or there is a need for switching to another processing band. The predetermined thresholds are typically values defined by the firmware executed on the processing unit. They give guidance on how to process the audio signals such that the user of the hearing device and the host device, experience the best service. The predetermined thresholds may be static values and they may have different values depending on, e.g., the type of the ongoing audio communication (phone call, listening to music, gaming, etc.). Predetermined threshold values for dual connection may be different from the thresholds for single connection, i.e. when the hearing device communicates with one host only. Furthermore, the predetermined threshold values may depend on requirements set by the user who may set, e.g., required signal-to-noise ratio.

If the audio signal is processed in the first frequency band, and the quality of the audio communication is below a first predetermined threshold, the processing unit will switch to the processing in the second frequency band. If the first frequency band is the wideband, where wide bandwidth signal may be covering frequencies in the range of 50 Hz—7 kHz, and the communication quality is below the first predetermined threshold, the processing unit will switch to the narrowband, where narrow bandwidth may be covering frequencies in the range of 300 Hz— 3.4 kHz, which is more robust when it comes to lower quality of the audio communication. Namely, the narrowband signal is transmitted/received with lower data flow and sample rate that allows the hearing device/host to retransmit the package for data correction without taking up the full communication capacity of the audio communication channel if a packet is lost. The switching between two bands is typically performed by switching the sampling frequency from one value to another, e.g. from 16 kHz to 8 kHz. If the quality of the audio communication is above the first predetermined threshold then the processing unit will continue processing the audio signals in the first frequency band.

If the audio signal is processed in the second frequency band, and if the quality of the audio communication is above the first predetermined threshold, the processing unit will then switch to processing in the first frequency band. In this scenario, due to high quality of the audio communication, better signal quality can be provided to the user. If the quality of the audio communication is below the first predetermined threshold then the processing unit will continue processing the audio signals in the second frequency band.

A frequency band may be related to the information size. Namely, a use of different frequency bands may result in a different information size to be transmitted. On a better link condition, more information can be processed in a wider frequency band to keep good sound quality. On a worse link condition, less, but e.g. necessary, information can be processed in a narrow frequency band to fulfil basic communication requirements. In general, the better the link quality is, the more data/information could be transmitted correctly in a fixed period of time. This means that the smaller the amount of data/information that need to be transmitted is, the stronger the link could be maintained.

The switching may be performed by a hearing device firmware which may be executed on the processing unit. The firmware may also be responsible for identifying the quality of the audio communication and comparing it with the first predetermined threshold. Once the result of comparison is obtained, application command may be sent and the is switching can be performed in real time and without any delays.

By adapting a frequency band in which the audio signal is processed, range performance, connectivity performance, noise immunity performance, signal-to-noise ratio sensitivity, and quality of the audio communication between the hearing device and the host are improved. The switching also adapts sensitivity of the audio communication to interference.

Range performance, i.e. range within which the hearing device functions effectively and without any interruption in data communication with another electronic device are improved by frequency band switching on the basis of audio communication quality. Larger distance between the hearing device and another electronic device can be allowed by switching from the first frequency band to the second frequency band.

Noise immunity performance, especially in high density environments with several wireless electronic devices, is improved by enabling switching between different frequency bands which have different noise tolerance.

Furthermore, user experience is improved as high wireless link performance and sound quality are secured all times during audio communication.

Frequency band switching in accordance with the present invention is obtained by an additional signal processing step performed by a processing unit which exists on all hearing devices similar to the one claimed. It is an advantage that this results in a low cost solution with improved performances as the solution does not require additional hardware components. Furthermore, the solution can be implemented quickly on an existing hearing device by upgrading a signal processing model executed by the processing unit.

By adaptively switching of the frequency band for signal processing, the hearing device can allow active use of two or more channels, i.e. active connection with two or more hosts exchanging data with the hearing device independently from each other. Since the number of host devices can influence the quality of the audio communication, frequency band switching ban be utilized to enable sufficiently good communication quality with all the hosts communicating with the hearing device.

In some embodiments, the quality of the audio communication may be determined based on a signal quality and/or based on a wireless connection quality.

When the processing unit receives an audio signal it may measure the quality of the received signal by determining various parameters of that audio signal to thereby derive is the quality of the audio communication. These various parameters may include signal-to-noise ratio (SNR), packet loss, errors, latency, packet delay variation, etc. These parameters are usually interrelated and one may be calculated from another. For instance, packet delay variation may be estimated from the packet loss and latency. Once the processing unit determines signal quality, the quality of the audio communication can be determined and compared with the predetermined thresholds.

The processing unit, which is typically connected to the wireless communication unit, may determine the quality of the wireless connection. Wireless connection quality may be influenced by increased distance between the hearing device and the host, by the presence of other electronic devices operating in the same ISM band (the same channel) as the hearing device, or by presence of people in the hearing device environment. The more devices operating on the same channel, the more interference each one will experience, and eventually causing packet loss in the audio signal communicated to/from the hearing device or even disconnection from the host device. The processing unit may, based on a received signal strength indicator (RSSI), determine the wireless connection quality. The processing unit detecting the wireless connection quality shall typically perform switching when RSSI drastically decreases and preferably before possible disconnection occurs. Measurements of SNR, RSSI, packet loss, etc., can be performed by a processing unit of an existing hearing device in the art. Namely, a built-in chipset of a hearing device commercially available in the market can perform these measurements and there is no need for upgrades of the hearing device.

In some embodiments, the quality of the audio communication may be quantified by a bit-error rate (BER), a packet-error rate (PER), or a cyclic redundancy check (CRC). The quality of the audio communication may also be quantified by measuring the RSSI. These parameters are easy to measure with well-know techniques making the hearing device of the present invention easy to implement. Quality of the audio communication may degrade for a number of reasons. The more Bluetooth and Wi-Fi devices are in the same room/space, the more impact on the audio communication quality it has. The hearing device typically uses 2.4 GHz ISM band for communication. Bluetooth and Wi-Fi devices such as wireless gaming or communication headsets, wireless mouse/keyboard, wireless microphones, laptops, tablets, smartphones, etc. may all also use 2.4 GHz band for communication thereby influencing the quality of audio communication between the is hearing device and host. Namely, a large number of wireless devices operating on the same channel increase the probability of co-channel frequency interference which then causes an increase of PER and package loss. Further, longer range between the hearing device and host, human body, various objects in the room, etc. also influence the quality of the audio communication between the hearing device and host. The quality of the audio communication is even more influenced by other wireless devices, people, objects, etc. in the hearing device surroundings when the hearing device is connected to two hosts. This is because the hearing device spends an extra payload to maintain the connection with a second host even if that connection is idle.

Audio latency is one of audio communication quality parameter. Long latency is usually not acceptable for hearing device users, especially for audio communication, e.g. phone calls, and gaming. Frequency band switching can also reduce the latency of the audio signal, e.g. when a user of the hearing device listens to music (receiving mode) or when the user is transmitting his voice via the host (transmitting mode).

Furthermore, poor connectivity performance of a host device may also influence the quality of the audio communication between the hearing device and host. Frequency band switching can also compensate for this quality signal degradation.

In some embodiments, the processing may comprise sampling the audio signal with a predetermined sampling frequency. Each frequency band may be characterized by its own predetermined sampling frequency. The first frequency band may be characterized by a first sampling frequency, and the second frequency band may be characterized by a second sampling frequency. The processing unit may be configured to sample received audio signals with at least two predetermined sampling frequencies. Audio signals to be transmitted from the hearing device to the host may also be sampled with the at least two sampling frequencies. The processing unit may change the sampling frequency in order to maintain good user experience and good sound quality all the time.

In some embodiments, the processing unit may further be configured to process the audio signal in a third frequency band and may be configured to switch to the third frequency band if the quality of the audio communication is above a second predetermined threshold. The third frequency band may be an ultra-wideband covering frequencies in the range 30 Hz— 12 kHz. Corresponding sampling frequency may be about 32 kHz. The third frequency band may deliver signals with ultra-high resolution and ultra-high precision. Naturally, these high quality signals may require ultra-high quality of the audio communication between the hearing device and the host. The present invention is not limited to switching between only three frequency bands, but may support four, five, six, etc. frequency bands.

The processing unit may support dual operating mode (dual channel), wherein the hearing device is connected to two hosts via the same wireless communication unit.

Different channels may have different requirements for signal quality. One operating mode (channel) may utilize one frequency band while the other operating mode (channel) may utilize either the same frequency band or another. Also, the switching between bands on different channels may be performed independently from each other.

In some embodiments, the first frequency band may have a sampling frequency in the middle range, e.g., the audio frequency band range covers from 10 kHz to 17 kHz, the second frequency band may have basic sampling frequency, e.g., the audio frequency band range covers from 1 kHz to 9 kHz, and the third frequency band may have a better sampling frequency in the audio frequency band, e.g., covering above 17 kHz. These audio frequency band ranges may be adjusted to get the best signal quality. The first frequency band may have a sampling frequency in the range of 10 kHz to 17 kHz, the second frequency band may have a sampling frequency in the range of 1 kHz to 9 kHz, and the third frequency band may have a sampling frequency in the range above 30 kHz.

The higher the sampling frequency is, the higher the resolution of the audio signal may be and thereby the signal quality. In order to transmit/receive signals with higher resolution, better quality of the audio communication between the hearing device and the host may be required. As a result, higher sampling frequencies may be utilized on shorter ranges compared to lower sampling frequencies.

The first frequency band may be referred to as a wideband. Audio signals processed in the first frequency band may have high definition and high resolution, and thereby high signal quality, higher than signals processed in the second frequency band. Audio signals processed in the second frequency band may be referred as narrowband signals which typically have lower definition and lower resolution compared to the wideband signals. The third frequency band may define audio signals with the highest resolution and definition compared to the first and second frequency band. In order to transmit/receive audio signals with high resolution, correspondingly high audio communication quality between the hearing device and the host may need to be established.

The number of frequency bands in which the audio signals can be processed may not be limited to only three and may not be limited to the specific ranges described above. Audio signals may also be processed in a fourth frequency band having a sampling frequency in the range of 17 kHz to 29 kHz. Additionally, each range may comprise sub ranges which define different signal quality requirements.

In some embodiments, the audio communication may be a phone call with a far-end caller. In this embodiment, the host is a phone or another device receiving the phone call, e.g. a computer, laptop, pc, tablet, etc. from the far-end caller. The quality of the audio communication may be influenced by the quality of the phone call itself, i.e. quality of communication between the far-end caller's phone and the user's phone, and the processing unit may need to encounter for that. Even in another embodiment, when the hearing device is receiving a music record, the processing unit may need to, besides the quality of the audio communication, encounter for the quality of the music record when deciding whether the band switching is required or not.

In some embodiments, the audio signal may comprise a speech signal. The speech signal may originate from a phone call, or from a TV, or from another media connected to the hearing device.

In some embodiments, the hearing device is a headset. The headset may comprise one or more earphones. The headset may comprise one or more microphones, e.g. in/on a microphone boom arm, to capture the voice of the user.

In some embodiments, the processing unit is configured to monitor the quality of the audio communication for a predetermined time period, and wherein the switching occurs after the predetermined time period.

In the second aspect, the present invention relates to a method for audio communication in a hearing device. The hearing device comprises a wireless communication unit and a processing unit. The method comprises receiving and/or transmitting, by the wireless communication unit, an audio signal. The audio signal may be communicated from the is wireless communication unit to the processing unit. The method further comprises processing, by the processing unit, the audio signal in a first frequency band or in a second frequency band and detecting the quality of the audio communication. If the audio signal is processed in the first frequency band, switching to the second frequency band if the quality of the audio communication is below a first predetermined threshold will be performed. If the audio signal is processed in the second frequency band, switching to the first frequency band if the quality of the audio communication is above the first predetermined threshold will be performed.

In a third aspect, a system comprising a hearing device and a first electronic device is disclosed. The first electronic device is paired with the hearing device. The hearing device comprises a wireless communication unit and a processing unit. The wireless communication unit is configured to receive and transmit audio signals from/to the first electronic device, i.e. a first host device. The processing unit is configured to:

- receive and/or transmit the audio signal from/to the wireless communication unit;
- process the audio signal in a first frequency band or in a second frequency band; and
- detect the quality of the audio communication. If the audio signal is processed in the first frequency band, the processing unit is configured to switch to the second frequency band if the quality of the audio communication is below a first predetermined threshold. If the audio signal is processed in the second frequency band, the processing unit is configured to switch to the first frequency band if the quality of the audio communication is above the first predetermined threshold.

In some embodiments, the system may further comprise a second electronic device, i.e. a second host device. The hearing device may be paired with the second electronic device. At least one of the first and second electronic devices may be connected with the hearing device via Bluetooth connection.

The system may further comprise a wireless dongle. The dongle may be physically connected with either the first or second electronic device. The dongle may establish pairing with the hearing device automatically, as soon as the dongle is connected with the first/second electronic device. The dongle may be a hearing device accessory. The dongle may advantageously be used as a bridge between the hearing device and the first/second electronic device allowing for faster pairing between the two.

The method according to the second aspect of the invention may be performed on the hearing device according to the first aspect of the invention. The skilled person would therefore readily understand that any feature described in combination with the first aspect of the invention could also be combined with the second aspect of the invention, and vice versa. Accordingly, the remarks set forth above with reference to the first aspect of the invention are equally applicable here. Also, any feature described in combination with the first aspect of the invention could be combined with the third aspect of the invention.

In the fourth aspect, disclosed is a hearing device configured for audio communication, the hearing device comprising a wireless communication unit and a processing unit, the wireless communication unit being configured to receive and transmit audio signals, the processing unit being configured to

- receive and/or transmit the audio signal from/to the wireless communication unit;
- detect the quality of the audio communication;
- process the audio signal in a first frequency mode or in a second frequency mode, the first frequency mode is selected when the quality of the audio communication is above a first predetermined threshold, the second frequency mode is selected when the quality of the audio communication is below the first predetermined threshold; and wherein the processing unit is further configured to switch between the first and second frequency mode on the basis of the detected quality of the audio communication.

The present invention relates to different aspects including the hearing device described above and in the following, and a corresponding system and a method, each yielding one or more of the benefits and advantages described in connection with the first mentioned aspect, and each having one or more embodiments corresponding to the embodiments described in connection with the first mentioned aspect and/or disclosed in the appended claims.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
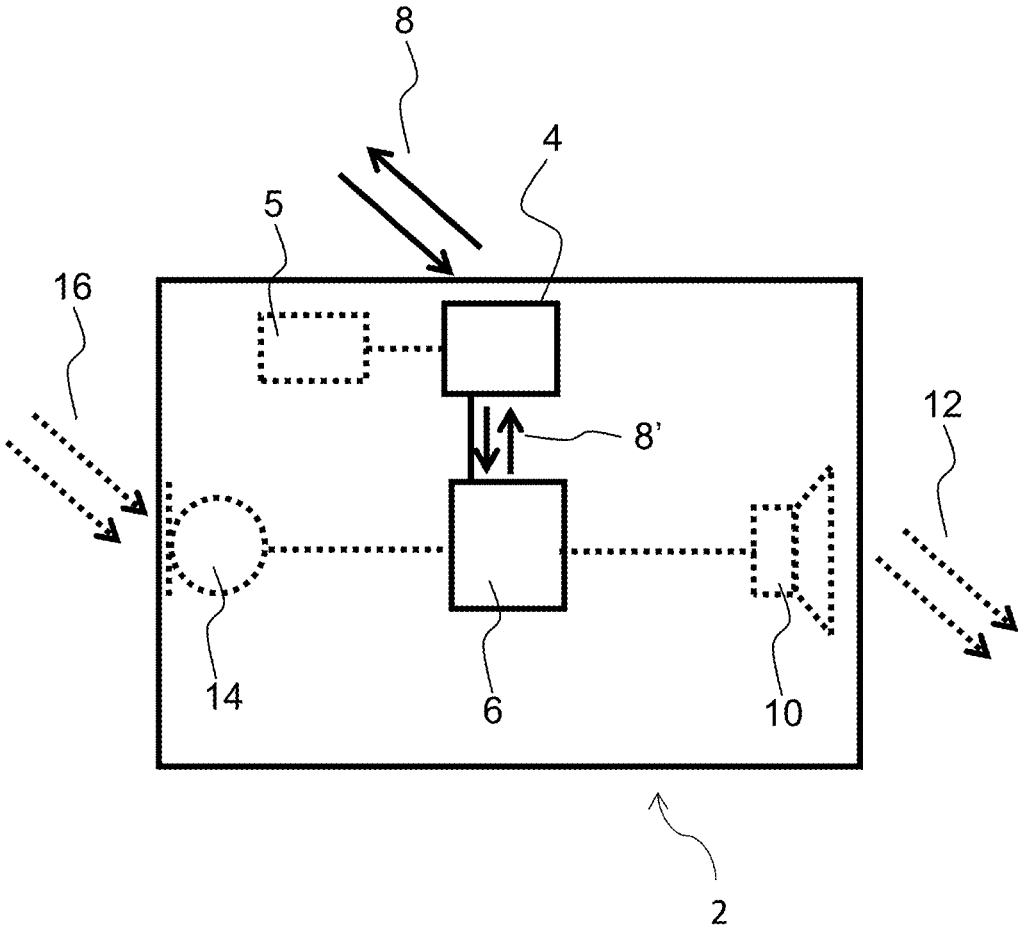
FIG. 1 schematically illustrates an exemplary hearing device according to a first aspect of the present invention, FIG. 2 schematically illustrates an exemplary method according to a second aspect of the present invention, FIG. 3 schematically illustrates an exemplary system according to a third aspect of the present invention, FIG. 4 graphically illustrates a single connection range comparison between processing in a wideband and in a narrowband, FIG. 5 graphically illustrates a dual connection range comparison between processing in a wideband and in a narrowband, and FIG. 6 schematically illustrates a narrowband (a) and a wideband (b) processing of an audio signal.

Various embodiments are described hereinafter with reference to the figures. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

Throughout, the same reference numerals are used for identical or corresponding parts.

FIG. 1 schematically illustrates an example of a hearing device 2 configured for audio communication. The hearing device 2 comprises a wireless communication unit 4 and a processing unit 6. The wireless communication unit 4 is configured to receive and is transmit audio signals 8. The processing unit 6 is configured to receive and/or transmit the audio signal 8' from/to the wireless communication unit 4. The processing unit 6 is further configured to process the audio signal in a first frequency band or in a second frequency band and to detect the quality of the audio communication. If the audio signal is processed in the first frequency band, the processing unit 6 will switch to processing in the second frequency band if the quality of the audio communication is or falls below a first predetermined threshold. If the audio signal is processed in the second frequency band, the processing unit 6 will switch to processing in the first frequency band if the quality of the audio communication is or rises above the first predetermined threshold.

The hearing device 2 may comprise a speaker 10 which receives processed audio signal 8' from the processing unit 6. The speaker 10 delivers sound signal 12 to a user of the hearing device 2.

The wireless communication unit 4 is configured to receive and transmit audio signals 8 from one or more host devices. The one or more host devices may be e.g. a smartphone and a softphone in a pc. The wireless communication unit 4 may receive and transmit the audio signals 8 from the one or more host devices via one or more antennas 5 connected with the wireless communication unit 4.

The hearing device 2 may comprise a microphone 14 which may receive the user's voice 16 and send it to the processing unit 6 for processing. The processing unit 6 may, based on the quality of audio communication between the hearing device and a host device, process the voice 16 in the first or in the second frequency band.

When the hearing device 2 receives audio signals 8, these signals are typically delivered to the user in the form of sound signal 12. When the hearing device 2 transmits audio signals 8, these signals typically contain the user's voice 16.

Thanks to automatic switching in signal processing in either the first or the second frequency band, good quality of both received and transmitted audio signals is achieved all times.

Figure 2:
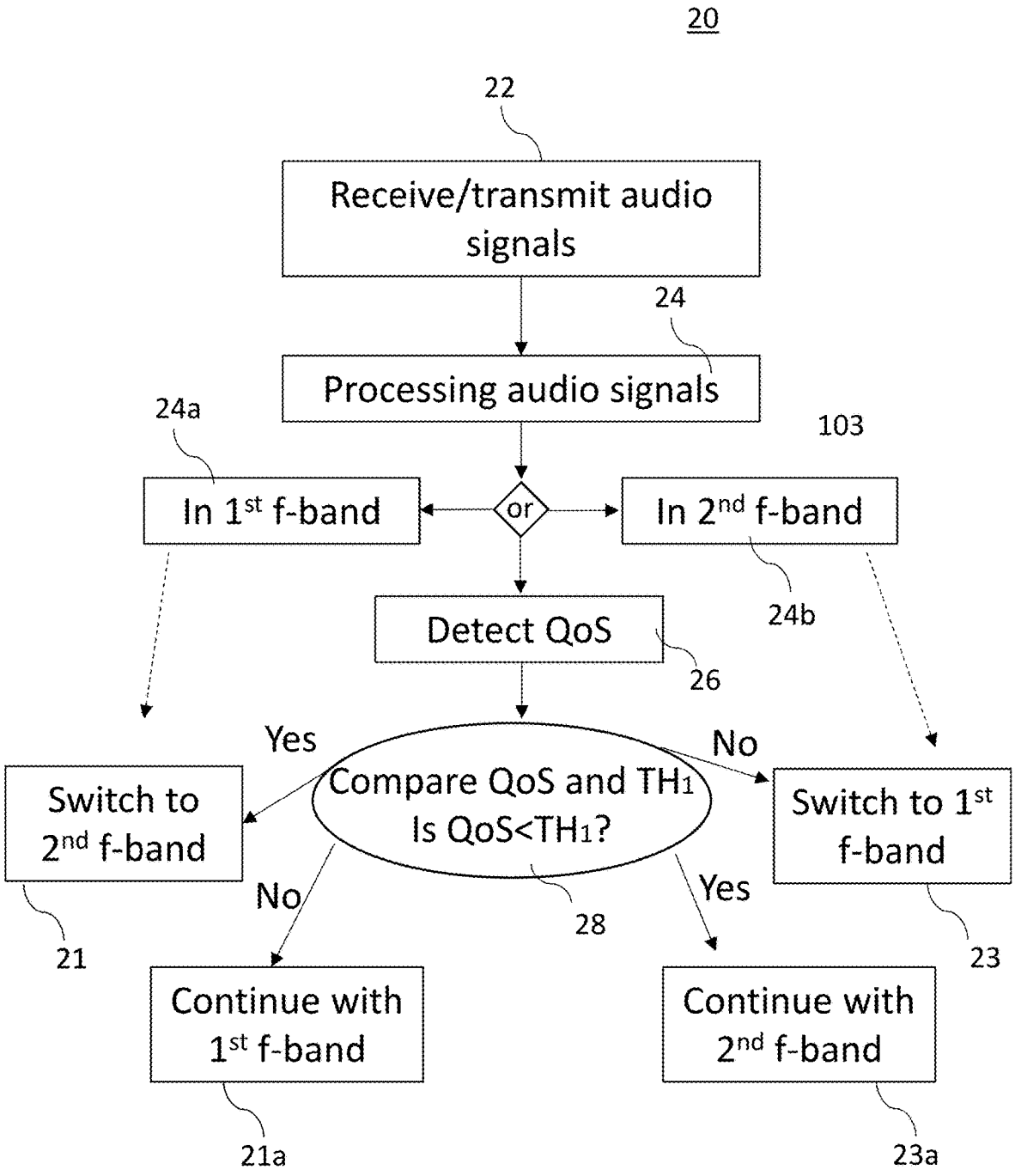

FIG. 2 schematically illustrates an example of a method 20 for audio communication in a hearing device, the hearing device comprising a wireless communication unit and a processing unit. The method is defined by a number of steps. In the first step 22, an audio signal is received and/or transmitted, by the hearing device, i.e. by the wireless communication unit. The processing unit is then processing 24 the audio signal in a first is frequency band 24*a* or in a second frequency band 24*b*. The processing unit is detecting 26 the quality of the audio communication, i.e. quality of service (QoS). The processing unit compares 28 the detected quality of the audio communication with a first predetermined threshold ($TH_1$). If the audio signal is processed in the first frequency band and the quality of the audio communication is or falls below a first predetermined threshold, the processing unit will switch 21 processing to the second frequency band. If the audio signal is processed in the first frequency band and the quality of the audio communication is not below the first predetermined threshold, the processing unit will continue processing 21*a* in the first frequency band. If the audio signal is processed in the second frequency band and the quality of the audio communication is not below but above the first predetermined threshold, the processing unit will switch 23 processing to the first frequency band. If the audio signal is processed in the second frequency band and the quality of the audio communication is below the first predetermined threshold, the processing unit will continue processing 23*a* in the second frequency band.

Figure 3:
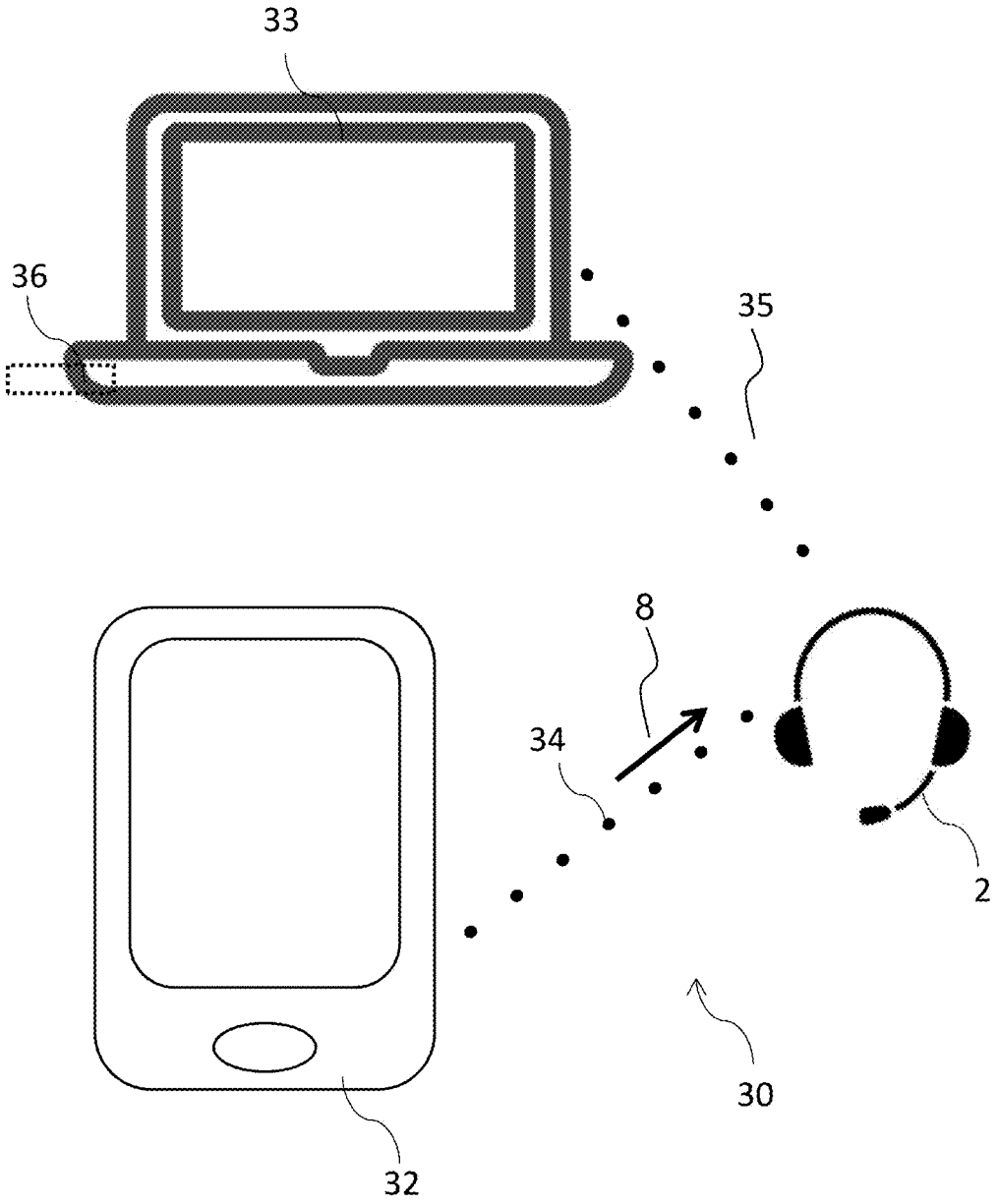

FIG. 3 schematically illustrates an example of a system 30 comprising a hearing device 2 and a first electronic device 32. The first electronic device 32 may be a host device for the hearing device 2. The first electronic device 32 is paired with the hearing device 2 and thereby a first wireless communication link 34 for audio communication is established there between. The system 30 may further comprise a second electronic device 33. The second electronic device 33 may also be a host device for the hearing device 2. The hearing device 2 is paired with the second electronic device 33 and a second wireless communication link 35 is established there between.

The hearing device 2 comprises a wireless communication unit and a processing unit (not shown), the wireless communication unit being configured to receive and transmit audio signals from/to the first electronic device 32. The processing unit is configured to receive and/or transmit the audio signal from/to the wireless communication unit, process the audio signal 8 in a first frequency band or in a second frequency band, and to detect the quality of the audio communication. If the audio signal 8 is processed in the first frequency band, the hearing device 2 will switch to processing in the second frequency band if the quality of the audio communication is or falls below a first predetermined threshold. If the audio signal is processed in the second frequency band, the hearing device 2 will switch to processing in the first frequency band if the quality of the audio communication is or rises above the first predetermined threshold.

The system 30 may comprise a dongle 36 which may establish wireless connection with the hearing device 2 automatically and there may be no need for pairing between the second electronic device 33 and the hearing device 2, as the dongle may physically be connected to the second electronic device 33. Alternatively or additionally, the dongle 36 may be physically connected to the first electronic device 32.

Figure 4:
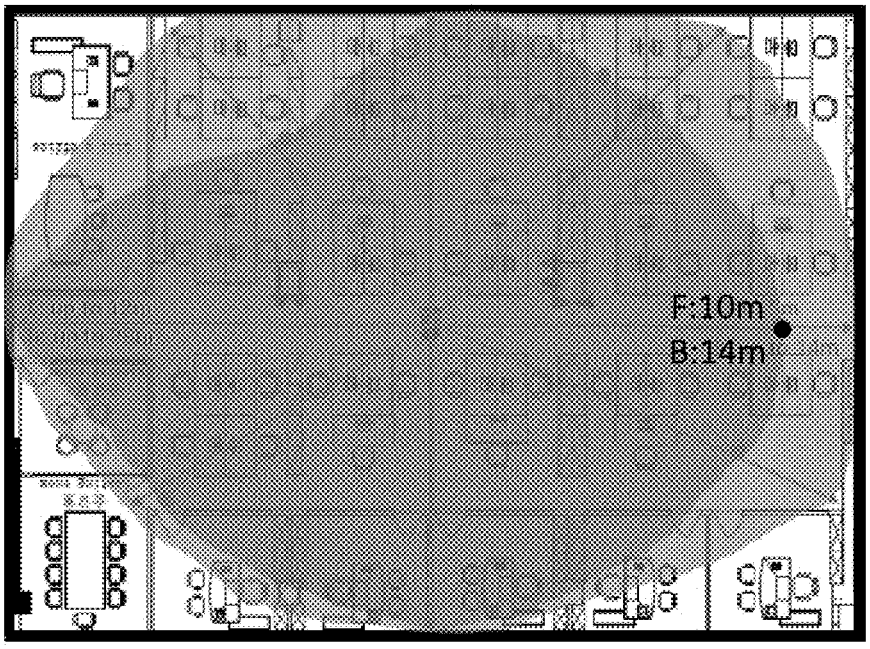
Figure 4:
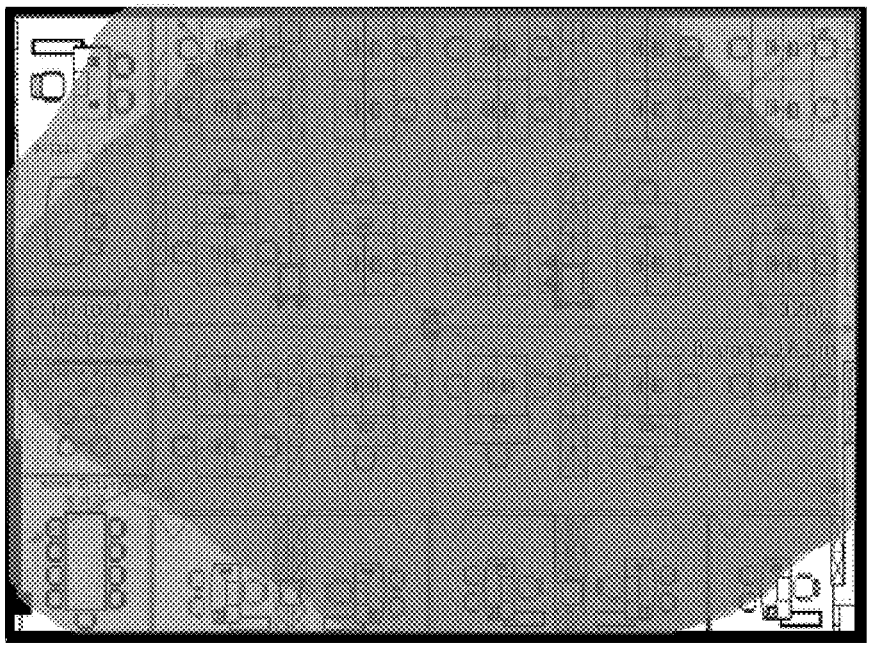

FIG. 4 graphically illustrates a single connection range comparison between processing in a wideband and in a narrowband. FIG. 4*a* illustrates a single connection range test when audio signals are processed in the wideband. In the test, a hearing device is in audio communication with only one host device and the audio signals are processed in the wideband. The dark grey area shows operational range of the hearing device when a user wearing the hearing device is facing the host device (F). The light grey area shows operational range of the hearing device when the user is with his back facing the host device (B). These positions are the best and the worst positions with respect to the host device. In this test, an antenna of the hearing device is positioned on the back of the user's neck. Within the shaded areas, the quality of transmitted/received audio signals is on an acceptable level. By comparing the graphs on FIG. 4*a* and FIG. 4*b* it can be seen that when the audio signals are processed in the narrowband (FIG. 4*b*), the operational range is larger for both front-facing (F) and back-facing (B) directions. This means that by switching from processing in wideband to processing in narrowband, greater ranges can be achieved while optimizing the quality of the audio signals.

Figure 5:
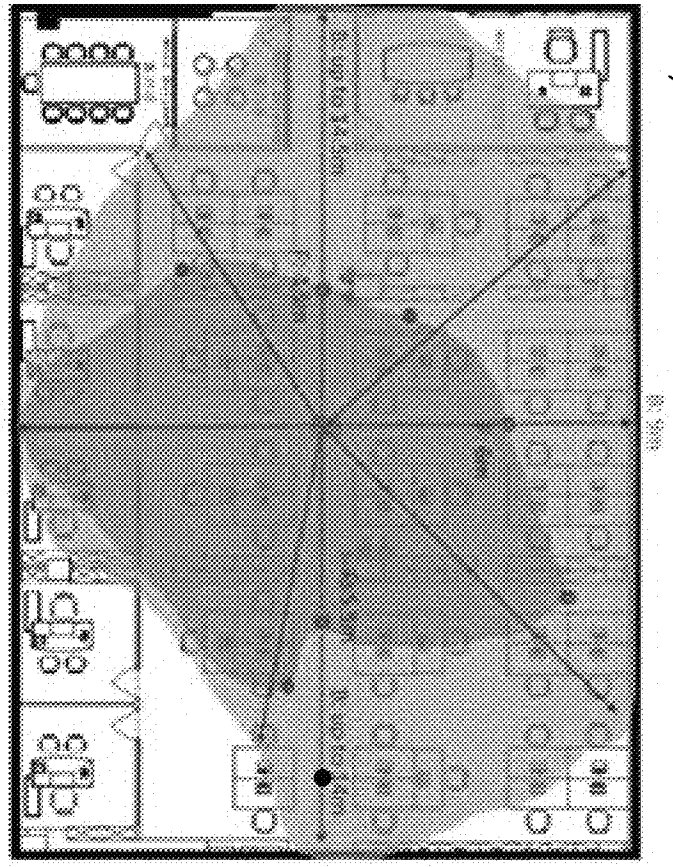
Figure 5:
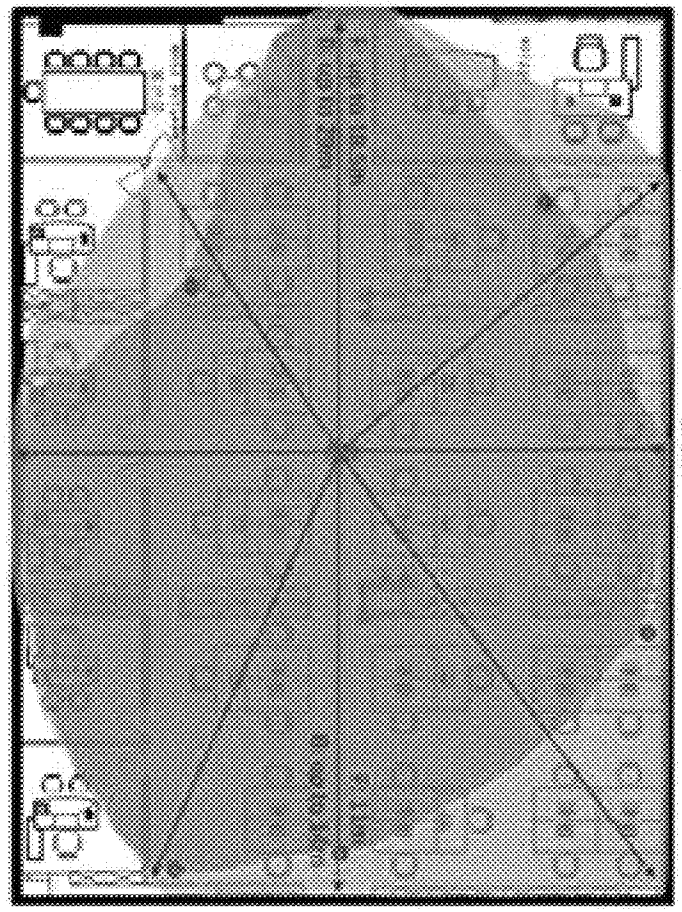

FIG. 5 graphically illustrates a dual connection range comparison between processing in a wideband and in a narrowband. Similar to FIG. 4*a*, FIG. 5*a* illustrates a dual connection range test when audio signals are processed in the wideband. In this test, a hearing device is in audio communication with two host devices and the audio signals are processed in the wideband. The dark grey area shows operational range of the hearing device when a user wearing the hearing device is facing one of the host devices (F). The light grey area shows operational range of the hearing device when the user is with his back facing the same host device (B). These positions are the best and the worst positions with respect to the host device. In this test, an antenna of the hearing device is positioned on the back of the user's neck. Within the shaded areas, the quality of transmitted/received audio signals is on an acceptable level. By comparing the graphs on FIG. 5*a* and FIG. 5*b* it can be seen that when the audio signals are processed in the narrowband (FIG. 5*b*), the operational range is larger for both front-facing (F) and back-facing (B) directions. This means that by switching from processing in wideband to processing in narrowband, significantly greater ranges can be achieved while optimizing the quality of the audio signals.

Figure 6:
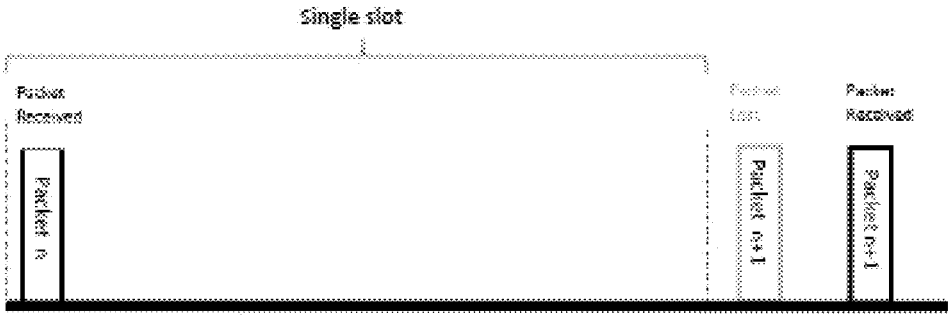
Figure 6:
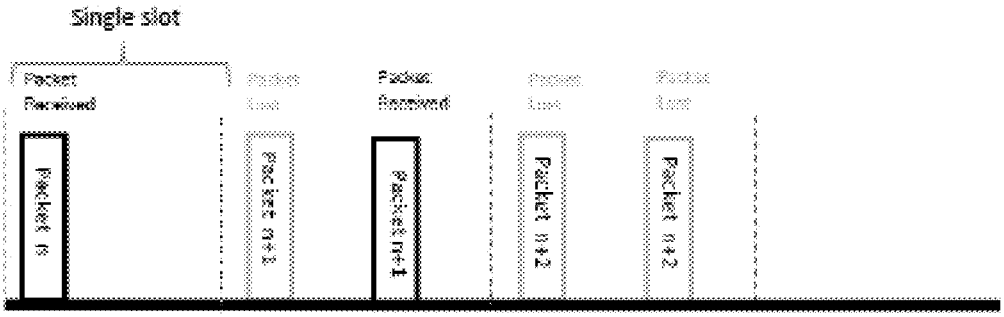

FIG. 6 schematically illustrates a narrowband (a) and wideband (b) processing of an audio signal. FIG. 6(*a*) illustrates that processing in the narrowband defines lower data flow and sample rate. The audio signal is transmitting slowly with longer time slot that allows the hearing device to retransmit the package for data correction without taking up the full communication capacity of the audio communication channel when/if a packet is lost. FIG. 6(*b*) illustrates that processing in the wideband defines higher data flow and sample rate. The audio signal is transmitting fast with much shorter time slot for data correction when/if a packet is lost.

In the real time audio system, the hearing device as the transmitter may not always retransmit the data on time, if the packet is badly lost due to noise interference, short RF range, high density, etc. The lost data will cause the poor sound quality and even worse the sound may not be recognized. The hearing device can transmit and retransmit the data during the longer time slot in the narrowband processing. It will secure a proper sound quality in the worst cases with bad connectivity. And it would bring better user experience in harsh electromagnetic environment and longer ranges.

Although particular features have been shown and described, it will be understood that they are not intended to limit the claimed invention, and it will be made obvious to those skilled in the art that various changes and modifications may be made without departing from the scope of the claimed invention. The specification and drawings are, accordingly to be regarded in an illustrative rather than restrictive sense. The claimed invention is intended to cover all alternatives, modifications and equivalents.

LIST OF REFERENCES

2 hearing device
4 wireless communication unit
5 antenna
6 processing unit
8 audio signals
10 speaker
12 sound signal
14 microphone
16 user's voice
20 method for audio communication in a hearing device
21 switching to a $2^{nd}$ frequency band
21*a* continue processing in a $1^{st}$ frequency band
22 receiving/transmitting an audio signal
23 switching to a $1^{st}$ frequency band
23*a* continue processing in a $2^{nd}$ frequency band
24 processing of an audio signal by a processing unit
24*a* processing in a $1^{st}$ frequency band
24*b* processing in a $2^{nd}$ frequency band
26 detecting the quality of the audio communication
28 comparing detected quality of the audio communication with a $1^{st}$ threshold
30 system
32 first electronic device
33 second electronic device
34 first wireless communication link
35 second wireless communication link
36 dongle

The invention claimed is:

1. A hearing device configured for audio communication, the hearing device comprising a wireless communication unit and a processing unit, the wireless communication unit being configured to receive and transmit audio signals, the processing unit being configured to:

receive and/or transmit the audio signal from/to the wireless communication unit;

process the audio signal in a first frequency band or in a second frequency band;

detect the quality of the audio communication; and if the audio signal is processed in the first frequency band, switch to the second frequency band if the quality of the audio communication is below a first predetermined threshold;

if the audio signal is processed in the second frequency band, switch to the first frequency band if the quality of the audio communication is above the first predetermined threshold; and wherein the processing unit is configured to monitor the quality of the audio communication for a predetermined time period and wherein the switching occurs after the predetermined time period.

2. A hearing device according to claim 1, wherein the quality of the audio communication is determined based on a signal quality and/or based on a wireless connection quality.

3. A hearing device according to claim 1, wherein the quality of the audio communication is quantified by a bit-error rate, a packet-error rate, or a cyclic redundancy check.

4. A hearing device according to claim 1 wherein the processing comprises sampling the audio signal with a predetermined sampling frequency.

5. A hearing device according to claim 1, wherein the processing unit is further configured to process the audio signal in a third frequency band and configured to switch to the third frequency band if the quality of the audio communication is above a second predetermined threshold.

6. A hearing device according to claim 1, wherein the first frequency band has a sampling frequency in the range of 10 kHz to 17 kHz, the second frequency band has a sampling frequency in the range of 1 kHz to 9 kHz, and the third frequency band has a sampling frequency in the range above 30 kHz.

7. A hearing device according to claim 1, wherein the audio communication is a phone call with a far-end caller.

8. A hearing device according to claim 1, wherein the audio signal comprises a speech signal.

9. A hearing device according to claim 1, wherein the hearing device is a headset.

10. A method for audio communication in a hearing device, the hearing device comprising a wireless communication unit and a processing unit, the method comprising:

receiving and/or transmitting, by the wireless communication unit, an audio signal;

processing, by the processing unit, the audio signal in a first frequency band or in a second frequency band;

detecting the quality of the audio communication;

monitoring the quality of the audio communication for a predetermined time period;

if the audio signal is processed in the first frequency band, switching to the second frequency band if the quality of the audio communication is below a first predetermined threshold for said predetermined periods of time;

if the audio signal is processed in the second frequency band, switching to the first frequency band if the quality of the audio communication is above the first predetermined threshold for said predetermined periods of time.

11. A system comprising a hearing device and a first electronic device, the first electronic device being paired with the hearing device, the hearing device comprising a wireless communication unit and a processing unit, the wireless communication unit being configured to receive and transmit audio signals from/to the first electronic device, the processing unit being configured to receive and/or transmit the audio signal from/to the wireless communication unit;

process the audio signal in a first frequency band or in a second frequency band;

detect the quality of the audio communication;

monitoring the quality of the audio communication for a predetermined time period;

if the audio signal is processed in the first frequency band, switch to the second frequency band if the quality of the audio communication is below a first predetermined threshold for said predetermined periods of time;

if the audio signal is processed in the second frequency band, switch to the first frequency band if the quality of the audio communication is above the first predetermined threshold for said predetermined periods of time.

12. A system according to claim 11, wherein the system further comprises a second electronic device, the hearing device being paired with the second electronic device.

* * * * *